US006986812B2

(12) United States Patent
Dubey et al.

(10) Patent No.: US 6,986,812 B2
(45) Date of Patent: Jan. 17, 2006

(54) SLURRY FEED APPARATUS FOR FIBER-REINFORCED STRUCTURAL CEMENTITIOUS PANEL PRODUCTION

(75) Inventors: Ashish Dubey, Grayslake, IL (US); Michael J. Porter, Hanover Park, IL (US)

(73) Assignee: United States Gypsum Company, Chicago, IL (US)

( * ) Notice: Subject to any disclaimer, the term of this patent is extended or adjusted under 35 U.S.C. 154(b) by 28 days.

(21) Appl. No.: 10/664,460

(22) Filed: Sep. 18, 2003

(65) Prior Publication Data

US 2005/0061237 A1 Mar. 24, 2005

(51) Int. Cl.
*B05C 1/08* (2006.01)

(52) U.S. Cl. ..... 118/259; 118/262; 118/304; 156/346

(58) Field of Classification Search ..... 118/259, 118/262, 304; 427/428, 428.01, 428.13, 427/428.14; 156/39–46, 346–348; 264/333, 264/112, 113

See application file for complete search history.

(56) References Cited

U.S. PATENT DOCUMENTS 2,276,244 A * 3/1942 Fischer et al. ..... 428/477.4
3,640,245 A * 2/1972 Schaefer ..... 118/259
3,901,634 A 8/1975 Webb et al.
4,050,864 A 9/1977 Komaki
4,287,846 A * 9/1981 Klein ..... 118/212
4,298,413 A * 11/1981 Teare ..... 156/42
4,420,295 A 12/1983 Clear et al.
4,504,335 A 3/1985 Galer
4,796,559 A 1/1989 Lohse
5,132,148 A * 7/1992 Reafler ..... 427/393.5
5,677,008 A 10/1997 Kameya et al.
5,685,903 A 11/1997 Stav et al.
5,718,797 A * 2/1998 Phillips et al. ..... 156/346
5,858,083 A 1/1999 Stav et al.
5,958,131 A 9/1999 Asbridge et al.
6,068,701 A * 5/2000 Kohler et al. ..... 118/249
6,176,920 B1 1/2001 Murphy et al.

FOREIGN PATENT DOCUMENTS

FR 951985 11/1949

* cited by examiner

*Primary Examiner*—Laura Edwards
(74) *Attorney, Agent, or Firm*—Greer, Burns & Crain, Ltd.; Michael Geoffrey; David Janci

(57) ABSTRACT

A feed apparatus for use in depositing a slurry upon a moving web having a direction of travel includes a main metering roll, a companion roll disposed in closely spaced relation to the metering roll to form a nip therebetween. The nip is constructed and arranged to retain a supply of the slurry, and the rolls are driven so that slurry retained in the nip progresses over an upper outer peripheral surface of the metering roll to be deposited upon the web. Also preferably included is a thickness control roll disposed in operational relationship to the metering roll for controlling thickness of a layer of slurry drawn from the nip over the outer metering roll surface. Preferably, the metering roll, the companion roll and the thickness control roll are driven in the same direction.

19 Claims, 2 Drawing Sheets

SLURRY FEED APPARATUS FOR FIBER-REINFORCED STRUCTURAL CEMENTITIOUS PANEL PRODUCTION

CROSS REFERENCE TO RELATED APPLICATIONS

This application is related to co-pending applications U.S. Ser. No. 10/666,294 entitled MULTI-LAYER PROCESS AND APPARATUS FOR PRODUCING HIGH STRENGTH FIBER-REINFORCED STRUCTURAL CEMENTITIOUS PANELS and U.S. Ser. No. 10/665,541 entitled EMBEDMENT DEVICE FOR FIBER-ENHANCED SLURRY, filed concurrently herewith and herein incorporated by reference.

FIELD OF THE INVENTION

This invention relates to a continuous process and related apparatus for producing structural panels using a settable slurry, and more specifically, to a slurry feeder apparatus used in the manufacture of reinforced cementitious panels, referred to herein as structural cement panels (SCP), in which fibers are combined with a quick-setting slurry for providing flexural strength.

Cementitious panels have been used in the construction industry to form the interior and exterior walls of residential and/or commercial structures. The advantages of such panels include resistance to moisture compared to standard gypsum-based wallboard. However, a drawback of such conventional panels is that they do not have sufficient structural strength to the extent that such panels may be comparable to, if not stronger than, structural plywood or oriented strand board (OSB).

Typically, the cementitious panel includes at least one hardened cement or plaster composite layer between layers of a reinforcing or stabilizing material. In some instances, the reinforcing or stabilizing material is fiberglass mesh or the equivalent. The mesh is usually applied from a roll in sheet fashion upon or between layers of settable slurry. Examples of production techniques used in conventional cementitious panels are provided in U.S. Pat. Nos. 4,420,295; 4,504,335 and 6,176,920, the contents of which are incorporated by reference herein. Further, other gypsum-cement compositions are disclosed generally in U.S. Pat. Nos. 5,685,903; 5,858,083 and 5,958,131.

One drawback of conventional processes for producing cementitious panels is that the fibers, applied in a mat or web, are not properly and uniformly distributed in the slurry, and as such, the reinforcing properties resulting due to the fiber-matrix interaction vary through the thickness of the board, depending on the thickness of each board layer. When insufficient penetration of the slurry through the fiber network occurs, poor bonding between the fibers and the matrix results, causing low panel strength. Also, in some cases when distinct layering of slurry and fibers occurs, improper bonding and inefficient distribution of fibers causes poor panel strength development.

Another drawback of conventional processes for producing cementitious panels is that the resulting product is too costly and as such is not competitive with outdoor/structural plywood or oriented strand board (OSB).

One source of the relatively high cost of conventional cementitious panels is due to production line downtime caused by premature setting of the slurry, especially in particles or clumps which impair the appearance of the resulting board, and interfere with the efficiency of production equipment. Significant buildups of prematurely set slurry on production equipment require shutdowns of the production line, thus increasing the ultimate board cost.

An important target area for reducing cementitious panel production line downtime due to premature setting is in the deposition or feeding of the slurry upon a moving web. In conventional cementitious panel production lines, the moving web includes a connected mat or layer of reinforcing fibers. In some applications, the slurry and/or fibers are sprayed upon the moving web. This system raises issues of maintenance of the spray equipment, since nozzles and pressure lines must be periodically purged of preset slurry particles. Also, this system risks uneven deposition of slurry due to the force and spacing of the spray heads.

An alternative conventional system for feeding cementitious slurry upon a moving web involves the use of a nip roll feeder. Counter-rotating rollers forming a nip create a reservoir for slurry, which migrates along an underside of one nip-forming roll to a feed roller. This arrangement carries with it the potential problem of slurry droplets prematurely falling upon the web from the underside of the nip roll, causing unwanted premature setting particles and uneven constitution of the finished cementitious panel. In addition, the thickness of the layer of slurry deposited upon the web can be uneven and difficult to control with this type of configuration. Further, this arrangement is believed to foster the collection of prematurely set particles of slurry, which require system shutdown for cleaning.

Thus, there is a need for a slurry feed device which is particularly useful in the feeding of cementitious, and /or gypsum-cement slurries of the type used in the production of cementitious construction panels. There is also a need for such a feed device in which the collection and/or clogging of prematurely set gypsum particles is prevented.

BRIEF DESCRIPTION OF THE INVENTION

The above-listed needs are met or exceeded by the present invention that features a slurry feed apparatus for use in a SCP panel production line or the like application where settable slurries are used in the production of building panels or board. The present apparatus includes a main metering roll and a companion roll placed in close, generally parallel relationship to each other to form a nip in which a supply of slurry is retained. Both rolls preferably rotate in the same direction so that slurry is drawn from the nip over the metering roll to be deposited upon a moving web of the SCP panel production line. A thickness control roll is preferably provided in close operational proximity to the main metering roll for maintaining a desired thickness of the slurry.

It is also preferred that the thickness control roll rotates in the same direction as the main and companion rolls.

More specifically, the invention provides a feed apparatus for use in depositing a slurry upon a moving web having a direction of travel, and includes a main metering roll and a companion roll disposed in closely spaced relation to the metering roll to form a nip therebetween. The nip is constructed and arranged to retain a supply of the slurry, and the rolls are driven so that slurry retained in the nip progresses over an upper outer peripheral surface of the metering roll to be deposited upon the web.

In another embodiment, a feed apparatus is provided for use in depositing a slurry upon a moving web having a direction of travel. The apparatus includes a main metering roll, a companion roll disposed in closely spaced relation to the metering roll to form a nip therebetween. The rolls are disposed generally transversely to the direction of travel of the web. Also, the nip is constructed and arranged to retain a supply of the slurry, and a thickness control roll is disposed in operational relationship to the metering roll for controlling the thickness of a layer of slurry drawn from the nip upon an outer surface of the metering roll. A drive system is provided for driving the metering roll, the companion roll and the thickness control roll in the same direction.

DETAILED DESCRIPTION OF THE INVENTION

Figure 1:
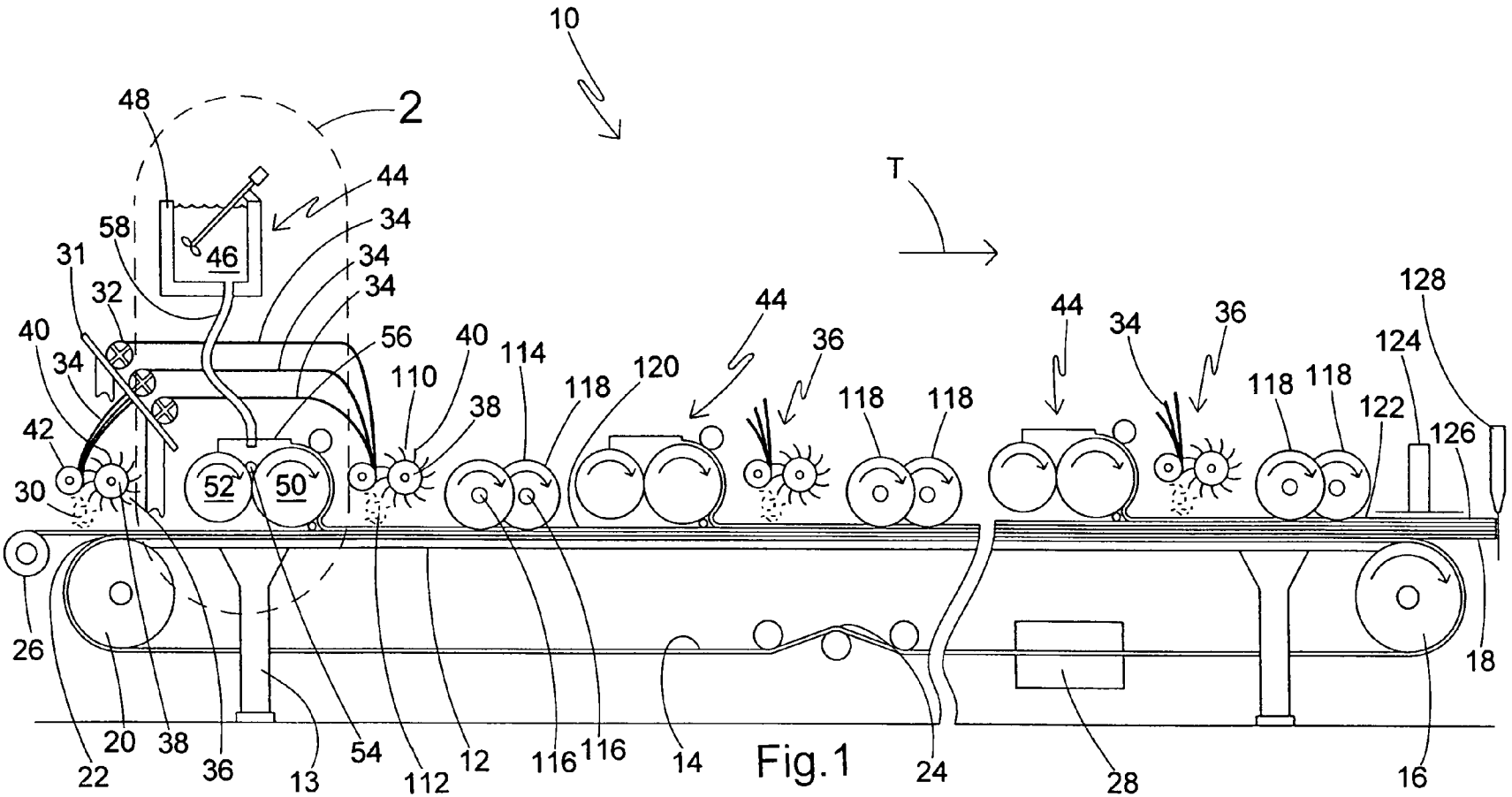
FIG. 1 is a diagrammatic elevational view of a SCP panel production line suitable for use with the present slurry feed device.

Referring now to FIG. 1, a structural panel production line is diagrammatically shown and is generally designated 10. The production line 10 includes a support frame or forming table 12 having a plurality of legs 13 or other supports. Included on the support frame 12 is a moving carrier 14, such as an endless rubber-like conveyor belt with a smooth, water-impervious surface, however porous surfaces are contemplated. As is well known in the art, the support frame 12 may be made of at least one table-like segment, which may include designated legs 13 or other support structure. The support frame 12 also includes a main drive roll 16 at a distal end 18 of the frame, and an idler roll 20 at a proximal end 22 of the frame. Also, at least one belt tracking and/or tensioning device 24 is preferably provided for maintaining a desired tension and positioning of the carrier 14 upon the rolls 16, 20. In the preferred embodiment, the SCP panels are produced continuously as the moving carrier proceeds in a direction 'T' from the proximal end 22 to the distal end 18.

Also, in the preferred embodiment, a web 26 of craft paper, release paper, and/or other webs of support material designed for supporting a slurry prior to setting, as is well known in the art, may be provided and laid upon the carrier 14 to protect it and/or keep it clean. However, it is also contemplated that the SCP panels produced by the present line 10 are formed directly upon the carrier 14. In the latter situation, at least one belt washing unit 28 is provided. The carrier 14 is moved along the support frame 12 by a combination of motors, pulleys, belts or chains which drive the main drive roll 16 as is known in the art. It is contemplated that the speed of the carrier 14 may vary to suit the application.

In the present invention, structural cement panel production is initiated by depositing a layer of loose, chopped fibers 30 upon the web 26. A variety of fiber depositing and chopping devices are contemplated by the present line 10, however the preferred system employs a rack 31 holding several spools 32 of fiberglass cord, from each of which a length or string 34 of fiber is fed to a chopping station or apparatus, also referred to as a chopper 36.

The chopper 36 includes a rotating bladed roller 38 from which project radially extending blades 40, and which is disposed in close, contacting rotating relationship with an anvil roll 42. Preferably, the blades 40 extend the width of the carrier 14 or the web 26. In the preferred embodiment, the bladed roller 38 and the anvil roll 42 are disposed in relatively close relationship such that the rotation of the bladed roller 38 also rotates the anvil roll 42, however the reverse is also contemplated. Also, the anvil roll 42 is preferably covered with a resilient support material against which the blades 40 chop the strands 34 into segments. The spacing of the blades 40 on the roller 38 determines the length of the chopped fibers. As is seen in FIG. 1, the chopper 36 is disposed above the carrier 14 near the proximal end 22 to maximize the productive use of the length of the production line 10. As the fiber strands 34 are chopped, the fibers fall loosely upon the carrier web 26.

Figure 2:
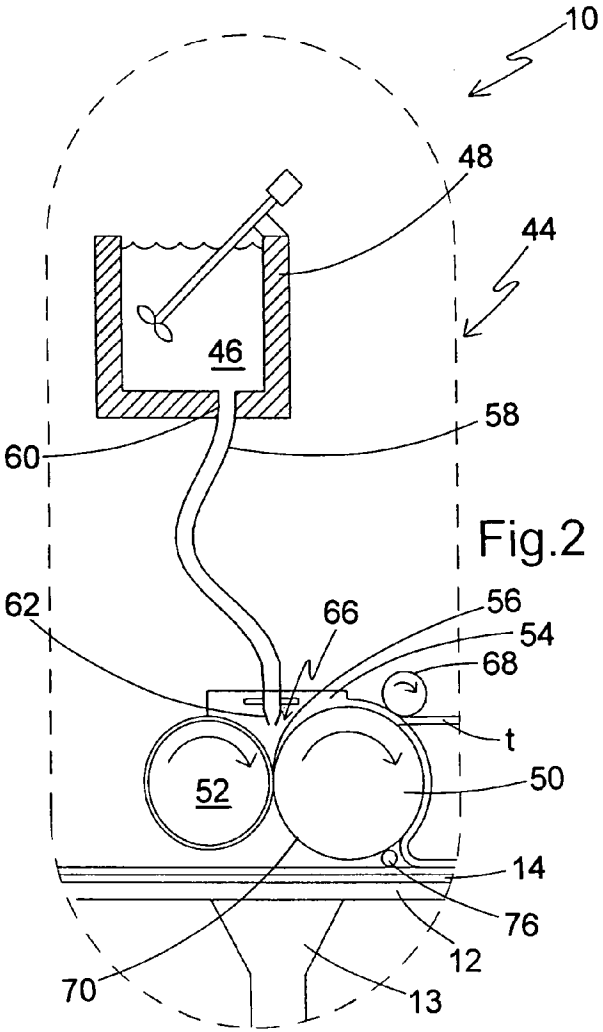
FIG. 2 is a fragmentary enlarged elevational view of the feed device depicted in FIG. 1.

Referring now to FIGS. 1 and 2 next, the present slurry feed apparatus, also referred to as a slurry feed station, or a slurry feeder, generally designated 44 receives a supply of slurry 46 from a remote mixing location 48 such as a hopper, bin or the like. While a variety of settable slurries are contemplated, the present process is particularly designed for producing structural cement panels. As such, the slurry 46 is preferably comprised of varying amounts of Portland cement, gypsum, aggregate, water, accelerators, plasticizers, foaming agents, fillers and/or other ingredients well known in the art, and described in the patents listed above which have been incorporated by reference. The relative amounts of these ingredients, including the elimination of some of the above or the addition of others, may vary to suit the application.

The preferred slurry feeder 44 includes a main metering roll 50 disposed transversely to the direction of travel of the carrier 14. A companion or back up roll 52 is disposed in close, parallel, rotational relationship to the metering roll 50 to form a nip 54 therebetween. The rolls 50, 52 are disposed in sufficiently close relationship that the nip 54 retains a supply of the slurry 46, at the same time the rolls rotate relative to each other. While other sizes are contemplated, it is preferred that the metering roll 50 has a larger diameter than the companion roll 52. Also, it is preferred that one of the rolls 50, 52 has a smooth, stainless steel exterior, and the other, preferably the companion roll 52 has a resilient, non-stick material covering its exterior.

A pair of relatively rigid sidewalls 56, preferably made of, or coated with non-stick material such as Teflon® brand material or the like, prevents slurry 46 poured into the nip 54 from escaping out the sides of the slurry feeder 44. The sidewalls 56, which are preferably secured to the frame 12, are disposed in close relationship to ends of the rolls 50, 52 to retain the slurry, however the sidewalls 56 are not excessively close to ends of the rolls to interfere with roll rotation.

An important feature of the present invention is that the feeder 44 deposits an even, relatively thin layer of the slurry 46 upon the moving carrier web 26. Suitable layer thicknesses range from about 0.08 inch to 0.16 inch. However, with four layers preferred in the preferred structural panel produced by the production line 10, and a suitable building panel being approximately 0.5 inch, an especially preferred slurry layer thickness is in the range of 0.125 inch.

To achieve a slurry layer thickness in the ranges described above, several features are provided to the slurry feeder 44. First, to ensure a uniform disposition of the slurry 46 across the entire web 26, the slurry is delivered to the feeder 44 through a hose 58 or similar conduit having a first end 60 in fluid communication with the slurry mixing tank or reservoir 48. A second end 62 of the hose 58 is connected to a laterally reciprocating, cable driven, fluid-powered dispenser 64 of the type well known in the art. Slurry flowing from the hose 58 is thus poured into the feeder 44 in a laterally reciprocating motion to fill a reservoir 66 defined by the rolls 50, 52 and the sidewalls 56. Rotation of the metering roll 50 draws a layer of slurry 46 from the reservoir 66.

Next, a thickness control roll or thickness monitoring roll 68 is preferably disposed slightly above the main metering roll 50 and slightly downstream of a vertical centerline of the main metering roll to regulate the thickness of the slurry 46 drawn from the feeder reservoir 66 upon an outer surface 70 of the main metering roll 50. Another related feature of the thickness control roll 68 is that it allows handling for slurries with different and constantly changing viscosities. As such, the thickness control roll 68 is located in operational relationship to the main metering roll 50 for regulating the thickness of the slurry carried from the reservoir 66 over the outer peripheral surface 70 of the main metering roll 50 for deposition upon the moving carrier web 26. As is well known in the art, the relative distance 't' (FIG. 2) between the thickness control roll 68 and the main metering roll 50 may be adjusted to vary the thickness of the slurry 46 deposited. Also, while other sizes are contemplated, it is preferred that the thickness control roll 68 has a smaller diameter than the companion roll 52 and a substantially smaller diameter than the main metering roll 50.

Another feature of the present feeder apparatus 44 is that the main metering roll 50, the companion roll 52 and the thickness control roll 68 are all driven in the same direction, which minimizes the opportunities for premature setting of slurry on the respective moving outer surfaces. A drive system 72, including a fluid-powered, electric or other suitable motor 74 is connected to the main metering roll 50 or the companion roll 52 for driving the roll(s) in the same direction, which is clockwise when viewed in FIGS. 1–3. As is well known in the art, either one of the rolls 50, 52 may be driven, and the other roll may be connected via pulleys, belts, chain and sprockets, gears or other known power transmission technology to maintain a positive and common rotational relationship. Further, the thickness control roll 68 is also configured to rotate in the same direction as the rolls 50, 52, and this is preferably achieved through a connection to the drive system 72, its own motor (not shown) or other arrangement well known to skilled practitioners, depending on the application.

As the slurry 46 on the outer surface 70 moves toward the moving carrier web 26, it is important that all of the slurry be deposited on the web, and not travel back upward toward the nip 54. Such upward travel would facilitate premature setting of the slurry on the rolls and would interfere with the smooth movement of slurry from the reservoir 66 to the carrier web 26. To that end, a transverse stripping wire 76 is located between the main metering roll 50 and the carrier web 26 to ensure that the slurry 46 is completely deposited upon the carrier web and does not proceed back up toward the nip 54 and the feeder reservoir 66. The stripping wire 76 also helps keep the main metering roll 50 free of prematurely setting slurry.

Figure 3:
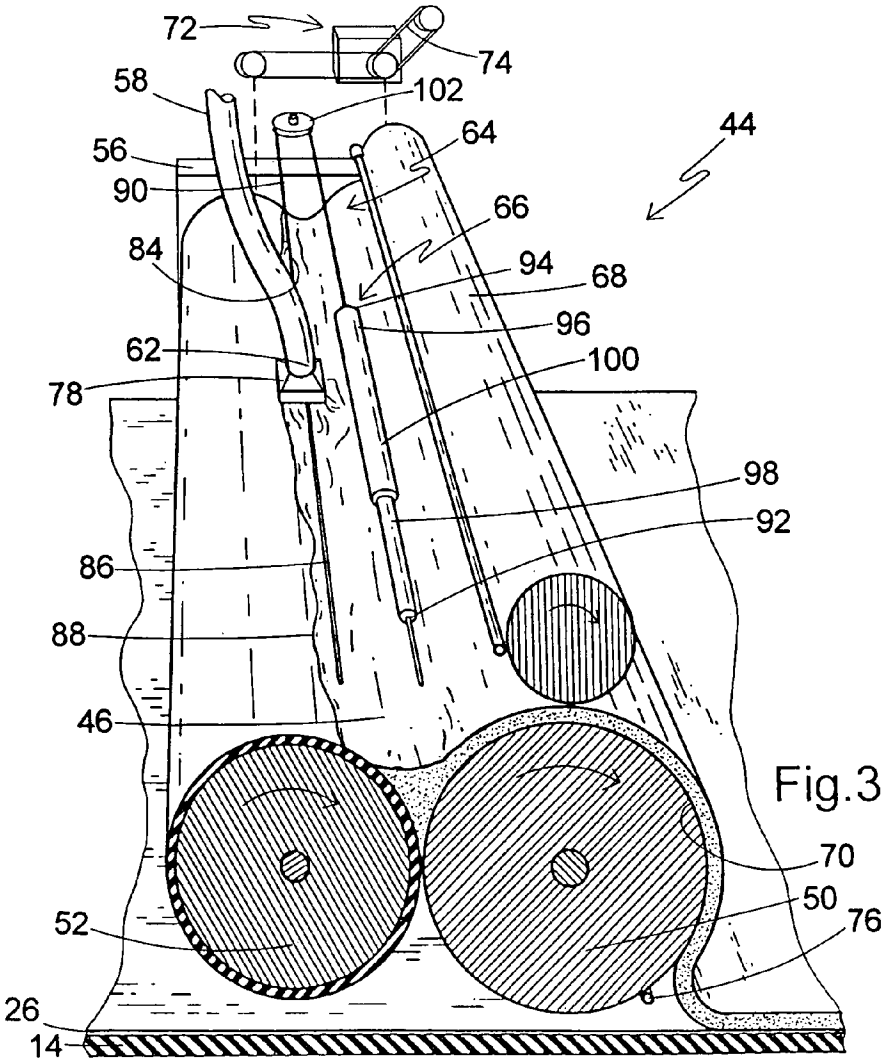
FIG. 3 is a perspective view of the present slurry feed apparatus.

Referring now to FIG. 3, the reciprocating dispensing mechanism 64 will be explained in greater detail. The second end 62 of the hose 58 is retained in a laterally reciprocating fitting 78 which is connected at each of two sides 80, 82 to corresponding ends 84, 86 of cable segments 88, 90. Opposite ends 92, 94 of the cable segments 88, 90 are connected to one of a blind end 96 and a rod 98 of a fluid power cylinder 100, preferably a pneumatic cylinder. The cable segments 88, 90 are looped about pulleys 102 (only one shown) located at each end of the feeder apparatus 44. The fluid power cylinder 100 is dimensioned so that the travel distance of the rod 98 approximates the desired length of travel of the dispensing fitting 78 in the reservoir 66. As the cylinder 100 is pressurized/depressurized, the fitting 78 will reciprocate above and along the nip 54, thus maintaining a relatively even level of the slurry 46 in the reservoir 66.

Referring again to FIG. 1, the other operational components of the SCP panel production line will be described briefly, but they are described in more detail in co-pending, commonly assigned US. patent application Ser. No. 10/666,294 entitled, MULTI-LAYER PROCESS AND APPARATUS FOR PRODUCING HIGH STRENGTH FIBER-REINFORCED STRUCTURAL CEMENTITIOUS PANELS which has been incorporated by reference.

A second chopper apparatus 110, preferably identical to the chopper 36, is disposed downstream of the feeder 44 to deposit a second layer of fibers 112 upon the slurry 46. Next, an embedment device 114 is disposed in operational relationship to the slurry 46 and the moving carrier web 26 of the production line 10 to embed the fibers 112 into the slurry 46.

While a variety of embedment devices are contemplated, including, but not limited to vibrators, sheep's foot rollers and the like, in the preferred embodiment, the embedment device 114 includes at least a pair of generally parallel shafts 116 mounted transversely to the direction of travel of the carrier web 14 on the frame 12. Each shaft 116 is provided with a plurality of relatively large diameter disks 118 which are axially separated from each other on the shaft by small diameter disks (not shown). During board production, the shafts and the disks 118 rotate together about the longitudinal axis of the shaft 116. As is well known in the art, either one or both of the shafts 116 may be powered, and if only one is powered, the other may be driven by belts, chains, gear drives or other known power transmission technologies to maintain a corresponding direction and speed to the driven shaft. The respective disks 118 of the adjacent, preferably parallel shafts 116 overlap and are intermeshed with each other for creating a "kneading" or "massaging" action in the slurry, which embeds the previously deposited fibers 112. In addition, the close, intermeshed and rotating relationship of the disks 118 prevents the buildup of slurry 46 on the disks, and in effect creates a "self-cleaning" action which significantly reduces production line downtime due to premature setting of clumps of slurry. By providing two sets of disks 118 which are laterally offset relative to each other, the slurry 46 is subjected to multiple acts of disruption, creating a "kneading" action which further embeds the fibers 112 in the slurry. The preferred embedment device 114 is described in greater detail in corresponding application Ser. No. 10/665,541—entitled EMBEDMENT DEVICE FOR FIBER-ENHANCED SLURRY, which has been incorporated by reference herein.

Once the fibers 112 have been embedded, a first layer 120 of the panel is complete. In the preferred embodiment, the height or thickness of the first layer 120 is in the approximate range of 0.05–0.15 inches. This range has been found to provide the desired strength and rigidity when combined with like layers in a SCP panel. However other thicknesses are contemplated depending on the application.

To build a SCP panel of desired thickness, additional layers are needed. To that end, multiple production modules, including slurry feeders 44, chopper stations 36 and embedment devices 114 may be provided for each successive layer.

In the preferred embodiment, four total layers are provided to form the SCP panel 122. Upon the disposition of the four layers of fiber-embedded settable slurry as described above, a forming device 124 is preferably provided to the frame 12 to shape an upper surface 126 of the panel 122. Such forming devices 124 are known in the settable slurry/ board production art, and typically are spring-loaded or vibrating plates which conform the height and shape of the multi-layered panel to suit the desired dimensional characteristics.

At this point, the layers of slurry have begun to set, and the respective panels 122 are separated from each other by a cutting device 128, which in the preferred embodiment is a water jet cutter. Other cutting devices, including moving blades, are considered suitable for this operation, provided that they can create suitably sharp edges in the present panel composition. The cutting device 128 is disposed relative to the line 10 and the frame 12 so that panels are produced having a desired length. Since the speed of the carrier 14 is relatively slow, the cutting device may be mounted to cut perpendicularly to the direction of travel of the carrier 14. With faster production speeds, such cutting devices are known to be mounted to the production line 10 on an angle to the direction of web travel. Upon cutting, the separated panels 122 are stacked for further handling, packaging, storage and/or shipment as is well known in the art.

While a particular embodiment of the present slurry feed apparatus for fiber-reinforced structural cementitious panel production has been shown and described, it will be appreciated by those skilled in the art that changes and modifications may be made thereto without departing from the invention in its broader aspects and as set forth in the following claims.

What is claimed is:

1. A feed apparatus for use in depositing a slurry upon a moving web having a direction of travel, comprising:

a main metering roll;

a companion roll disposed in closely spaced relation to said metering roll to form a nip therebetween;

said nip constructed and arranged to retain a supply of the slurry;

a reciprocating slurry delivery mechanism constructed and arranged for providing slurry to said nip; and means for driving said rolls so that slurry retained in said nip progresses in the direction of travel of said web over an upper outer peripheral surface of said metering roll to be deposited upon the web.

2. The apparatus of claim 1 further including at least one sidewall disposed closely adjacent respective ends of said rolls for forming a slurry reservoir above said nip.

3. The apparatus of claim 2 wherein said sidewalls are made of a non-stick material.

4. The apparatus of claim 1 wherein said metering roll has a relatively larger diameter than said companion roll.

5. The apparatus of claim 1 wherein said metering roll and said companion roll have one of a stainless steel peripheral surface and a resilient, non-stick peripheral surface.

6. The apparatus of claim 1 further including a thickness control roll disposed in close operational proximity to said metering roll for controlling the thickness of the slurry layer deposited upon the web by said apparatus.

7. The apparatus of claim 6 wherein said thickness control roll is located above said metering roll.

8. The apparatus of claim 6 wherein said metering roll and said companion roll rotate in the same direction and further wherein said thickness control roll rotates in the same direction as said metering and companion rolls.

9. The apparatus of claim 6 wherein said thickness control roll has a diameter substantially smaller than said metering roll.

10. The apparatus of claim 1 wherein said delivery mechanism includes a conduit carrying connected to a source of slurry and having an end in close proximity to said nip, said conduit end being engaged in a reciprocating mechanism which laterally reciprocates said conduit end between ends of said metering and companion rolls.

11. The apparatus of claim 10 wherein said reciprocating mechanism includes a fluid powered cylinder and a cable-pulley.

12. The apparatus of claim 1 further including a stripping wire disposed adjacent a lower portion of said metering roll for preventing slurry from progressing upon an underside of said metering roll towards said nip.

13. The apparatus of claim 1 wherein said rolls are disposed generally transversely to the direction of travel of the web.

14. A feed apparatus for use in depositing a slurry upon a moving web having a direction of travel, comprising:

a main metering roll;

a companion roll disposed in closely spaced relation to said metering roll to form a nip therebetween, said rolls being disposed generally transversely to the direction of travel of the web;

said nip constructed and arranged to retain a supply of the slurry;

a thickness control roll disposed in operational relationship to said metering roll for controlling thickness of a layer of slurry drawn from said nip upon an outer surface of said metering roll; and means for driving said metering roll, said companion roll and said thickness control roll in the same direction.

15. The apparatus of claim 14 wherein said direction of rotation is towards the direction of travel of the moving web.

16. The apparatus of claim 14 further including at least one sidewall disposed closely adjacent respective ends of said rolls for forming a slurry reservoir above said nip.

17. The apparatus of claim 14 wherein said metering roll has a larger diameter than said companion roll, and said companion roll has a larger diameter than said thickness control roll.

18. The apparatus of claim 14 further including a stripping wire disposed adjacent a lower portion of said metering roll for preventing slurry from progressing upon an underside of said metering roll towards said nip.

19. A feed apparatus for use in depositing a slurry upon a moving web having a direction of travel, comprising:

a main metering roll;

a companion roll disposed in closely spaced relation to said metering roll to form a nip therebetween, said rolls being disposed generally transversely to the direction of travel of the web;

said nip constructed and arranged to retain a supply of the slurry;

a pair of sidewalls located adjacent ends of said metering and companion rolls to form a slurry reservoir;

a thickness control roll disposed in operational relationship to said metering roll for controlling thickness of a layer of slurry drawn from said nip upon an outer surface of said metering roll;

means for driving said rolls in the same direction so that slurry retained in said nip progresses over an upper outer peripheral surface of said metering roll to be deposited upon the web; and a reciprocating slurry delivery mechanism for providing slurry to said reservoir.

* * * * *